US009149946B2

(12) United States Patent
Porat

(10) Patent No.: US 9,149,946 B2
(45) Date of Patent: Oct. 6, 2015

(54) APPARATUS AND METHOD FOR MANUFACTURING HARD BOOK COVER COMPONENTS

(75) Inventor: Thomas Porat, Greenland, NH (US)

(73) Assignee: GP Squared Technologies, Inc., Bow, NH (US)

( * ) Notice: Subject to any disclaimer, the term of this patent is extended or adjusted under 35 U.S.C. 154(b) by 214 days.

(21) Appl. No.: 13/468,088

(22) Filed: May 10, 2012

(65) Prior Publication Data

US 2012/0285303 A1 Nov. 15, 2012

Related U.S. Application Data

(60) Provisional application No. 61/484,599, filed on May 10, 2011.

(51) Int. Cl.

| | |
|---|---|
| ***B26D 3/00*** | (2006.01) |
| ***B26D 7/26*** | (2006.01) |
| ***B65H 35/00*** | (2006.01) |
| ***B26D 1/08*** | (2006.01) |
| ***B26D 7/06*** | (2006.01) |
| *B26D 1/22* | (2006.01) |
| *B26D 5/12* | (2006.01) |
| *B26D 7/00* | (2006.01) |

(52) U.S. Cl.

CPC ..... *B26D 1/08* (2013.01); *B26D 7/0641* (2013.01); *B26D 1/22* (2013.01); *B26D 5/12* (2013.01); *B26D 2007/0081* (2013.01); *Y10T 83/04* (2015.04); *Y10T 83/0524* (2015.04); *Y10T 83/2192* (2015.04); *Y10T 83/647* (2015.04); *Y10T 83/6571* (2015.04); *Y10T 83/664* (2015.04)

(58) Field of Classification Search

CPC .... B26D 1/08; B26D 1/22; B26D 2007/0081; B26D 5/12; B26D 7/0641; Y10T 83/04; Y10T 83/0524; Y10T 83/2192; Y10T 83/647; Y10T 83/664; Y10T 83/6571

USPC ..... 83/301, 508, 508.1, 508.2, 508.3, 39, 83/44, 45, 47; 412/16, 19

See application file for complete search history.

(56) References Cited

U.S. PATENT DOCUMENTS

| | | | | |
|---|---|---|---|---|
| 4,300,427 | A * | 11/1981 | Rathert | 83/519 |
| 6,379,094 | B1 | 4/2002 | Porat | |
| 6,520,058 | B2 * | 2/2003 | Nakajima et al. | 83/206 |
| 8,123,449 | B2 | 2/2012 | Porat | |
| 8,291,799 | B2 * | 10/2012 | Graushar et al. | 83/247 |
| 2003/0131699 | A1 * | 7/2003 | Lai et al. | 83/13 |
| 2005/0100429 | A1 * | 5/2005 | Oki et al. | 412/16 |
| 2007/0144321 | A1 * | 6/2007 | Cote et al. | 83/13 |

* cited by examiner

*Primary Examiner* — Stephen Choi

(74) *Attorney, Agent, or Firm* — Finch & Maloney PLLC

(57) ABSTRACT

An apparatus, method, and system are provided for cutting panels of stock material for producing hard book casings. The apparatus may include a transport mechanism, a vertical cutter, and/or a horizontal cutter. The vertical cutter may produce a vertical cut of the stock material. The horizontal cutter may produce a horizontal cut of the stock material. The apparatus may produce properly dimensioned panels from the stock material in a single pass.

19 Claims, 10 Drawing Sheets

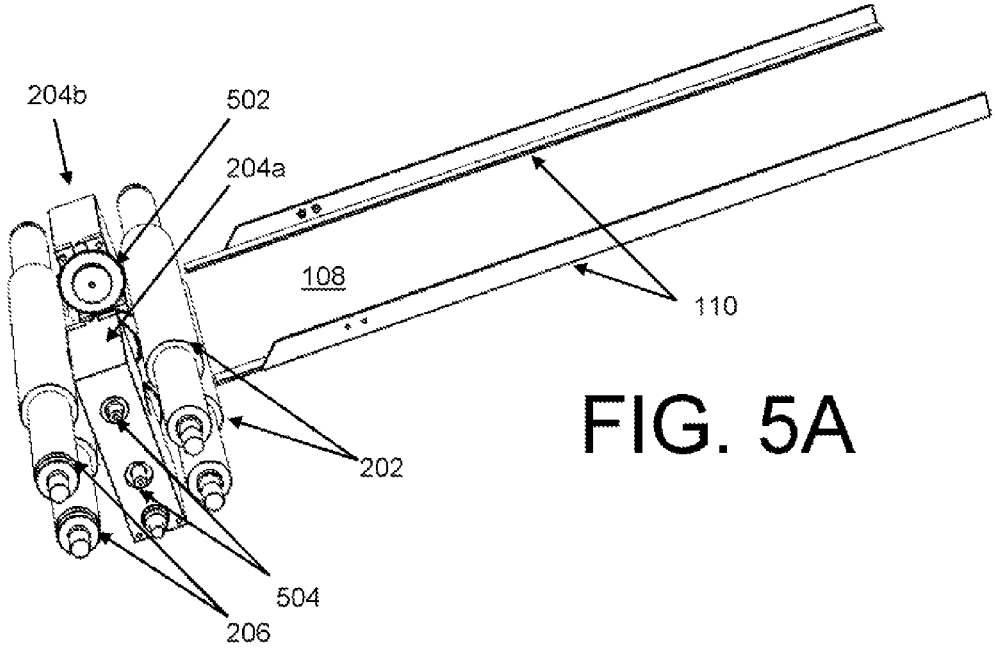
FIG. 5A
FIG. 5B
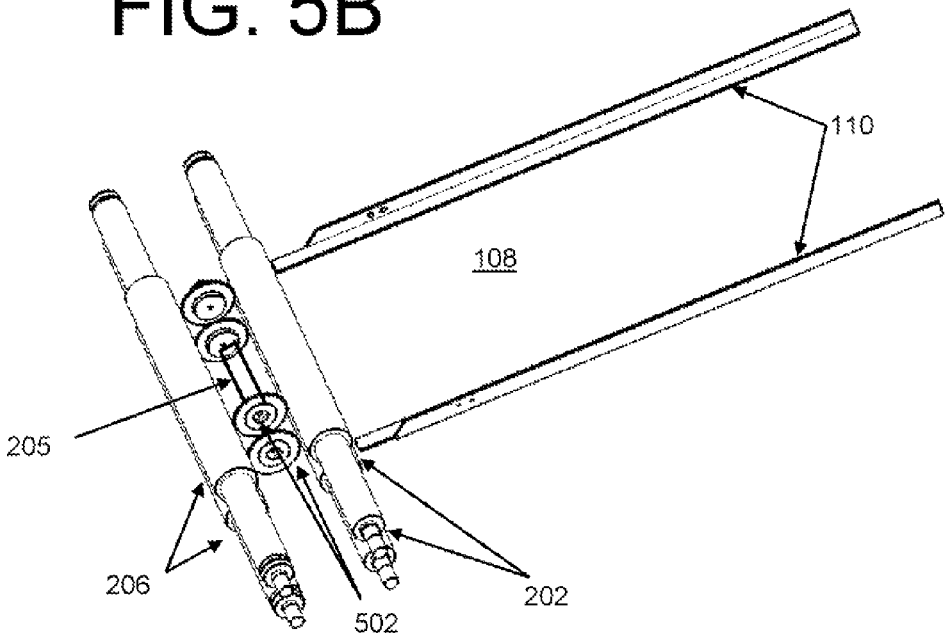

APPARATUS AND METHOD FOR MANUFACTURING HARD BOOK COVER COMPONENTS

RELATED APPLICATIONS

This application claims benefit of U.S. Provisional Application No. 61/484,599, filed on May 10, 2011, and titled APPARATUS AND METHOD FOR MANUFACTURING HARD BOOK COVER COMPONENTS. This application is hereby incorporated by reference herein.

FIELD OF INVENTION

This application relates to a method and apparatus for cutting panels of material and, in particular, is directed to a method and apparatus for cutting book cover and spine panels for hard book cover assemblies.

BACKGROUND

Cases for hard cover books are typically produced by printing a rectangular sheet of paper, cloth, or leather, known as the cover material, and subsequently gluing the cover material to two cover panels and a spine panel. The cover panels and spine panel (the rigid component) provide rigidity for the case, with one of the cover panels forming the front of the finished book and the second forming the back. The spine panel provides rigidity to the spine portion of the book. The cover panels are typically made of chipboard or other stiff material, whereas the spine may be made of chipboard or a thinner, more flexible material. A space is usually left between the spine and the panels so that the cover may be opened and closed in hinge-like fashion. Manufacturing techniques typically include a step of placing the cover panels and spine panel on a glued cover material and then folding the edges of the cover material up and onto the inside edges of the panels (and the ends of the spine). Together, the spine panel, cover panels, and cover material are known as a hard book cover assembly or case.

In an unfinished hard book cover assembly, the cover material is sized and placed to extend outwardly past the periphery of the spine panel and the cover panels to be later folded back over the edges of the spine panel and cover panels to produce an attractive cover. The overlapping edges of the cover material are glued on the inside of the panels and spine, and these edges are generally hidden later in the book-making process when paper or other material is glued over the interior of the hard book cover in a manner that overlaps, and thus hides, the edge of the cover material from a reader. Typically, only a few millimeters of cover material are visible around the inside edges when a hard cover book is completed. Procedures for fabricating a hard cover book are described below and in co-owned U.S. Pat. No. 6,379,094 (the '094 patent) and U.S. patent application Ser. No. 11/634,968, which are hereby incorporated by reference in their entireties herein.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIGS. 5A and 5B are perspective views of a vertical cutter and transport mechanism of the cutting apparatus according to the exemplary embodiment of the invention;

SUMMARY

Figure 1:
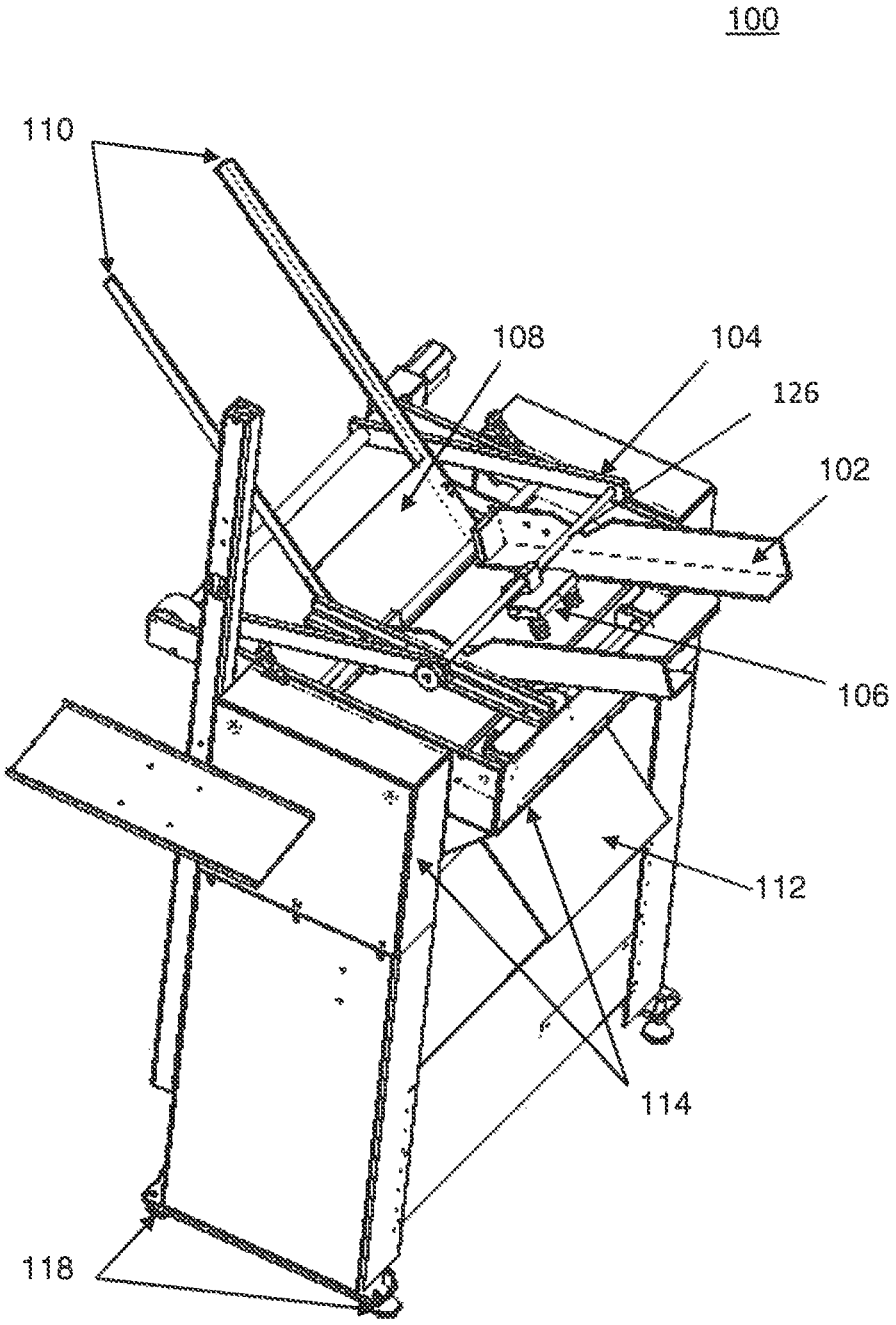
FIG. 1 is a perspective view of the cutting apparatus according to an exemplary embodiment of the invention.

This disclosure describes an apparatus, system, and method for cutting panels of material. An exemplary apparatus for making book cover panels may include any combination of a feeder, a transport mechanism, a vertical cutter, and/or a horizontal cutter. The feeder may feed a sheet of stock material to the transport mechanism. The transport mechanism then can advance the sheet to one or more cutters and/or printers. The transport mechanism also enables the controller to track the position of the sheet through the production process. The vertical cutter may produce one or more vertical cuts of the stock material. The horizontal cutter may produce a horizontal cut of the stock material that is at, or substantially at, right angles to the vertical cut. The apparatus may provide a properly cut panel of predetermined dimensions from the stock material.

In one aspect, the vertical cutter is a top right circular rotating blade and a bottom right circular rotating blade arranged to produce a right side vertical cut of the stock material and/or a top left circular rotating blade and a bottom left circular rotating blade arranged to produce a left side vertical cut of the stock material. The edges of the top and bottom circular blades may be separated by a distance that provides both a cutting and crushing action on the stock material. The top and bottom circular blades may rotate in opposite directions. It is understood that repositioning the vertical cutters while engaged in a sheet of stock material would require increasing the distance of separation between the circular blades to a dimension greater than the thickness of the material being cut. Cutting methods such as laser or water jet would be capable of changing the vertical cut position while engaged in a sheet of cover stock.

In another aspect, the vertical cutter may be coupled to an adjustable yoke for adjusting a horizontal position of the vertical cut so that panels and spines of different sizes can be produced. In another aspect, a right guide rail and a left guide rail with a downward slope toward the transport mechanism may be arranged to gravity feed the stock material to the cutting apparatus. In yet another aspect, the horizontal cutter comprises a straight blade and an anvil for producing a horizontal crush cut of the stock material. The blade of the horizontal cut may extend completely across the sheet of stock material so as the material is cut, minimal stress is applied to the panel or spine. The horizontal cutter may produce a horizontal cut of the stock material perpendicular to a cutting axis of the vertical cutter. The horizontal cut may be made through the entire width of the stock material, and it thus can be longer than the edge of a panel or spine that is being produced. The horizontal cutter may be configured to crush cut the stock after the stock material has been positioned properly and stopped prior to the cutter being activated, or it may be configured to cut while the material remains in motion. Horizontal cutting while the material is in motion may be accomplished by using a rotary straight knife, where the cutting edge is parallel to, but offset from, its axis of rotation. Horizontal cutting while the material is in motion also may be accomplished by moving a single point cutter (laser, water jet, or shear, for example) across the material but at an angle that allows the cutter to follow the material "downstream" as it cuts squarely across the material. Another method of making a horizontal cut while the material is in motion is to provide a horizontal cutter which is movable as an assembly in the axis parallel to the travel of the material. In this case, horizontal cuts may occur while both the material and the cutter assembly are moving with no relative motion between them. Once the cut is made, the assembly may return to the "upstream" extent of its travel.

In another aspect, the system may include a waste separator that may be a conveyor belt that removes cut waste material from the book cover panels. The conveyor belt may have a width narrower than the minimum height of the book cover panel. The conveyor belt may advance in a first direction to deposit waste material and a second direction to deposit the cut hard book cover panels. It is understood that a diversion gate may be used in a similar manner for waste separation.

In another aspect, the vertical cutter position may be adjusted between the feeding of individual sheets of stock material.

In yet another aspect, a controller may determine and instruct a horizontal and vertical cutting distance for each sheet of stock material. The controller may direct a horizontal and vertical cutting distance for each sheet of stock material based on each desired book cover dimension. The controller may direct the quantity of spines and panels to be cut from each sheet of stock material. A controller may direct the horizontal and vertical cutters to produce panels and/or spines for more than or less than one hard cover book assembly from a single sheet of stock material. The ability to produce more than or less than one hard cover book assembly from a single sheet of stock material may increase production speed and reduce material waste. Some hard cover book assemblies are made with flexible spines of different material. Flexible spines typically are made from a thick paper material and typically are used when the spine of the book is rounded. A controller may direct the horizontal and vertical cutters to produce only panels for books that will require flexible spines or no spines at all. In yet another aspect, a controller may direct the horizontal and vertical cutters to produce only spines. Typically, a spine and panel set consisting of two panels and a matching spine can be cut from a single sheet of stock material in a single run. In other embodiments, two or three or more of these sets can be cut from a single sheet. In other embodiments, multiple panels alone or multiple spines alone may be cut from a single sheet in order to maximize the use of the sheet material and to minimize waste.

This invention is not limited in its application to the details of construction and the arrangement of components set forth in the following description or illustrated in the drawings. The invention is capable of other embodiments and of being practiced or of being carried out in various ways. Also, the phrasing and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

DETAILED DESCRIPTION

In hard book cover making operations, it typically is desirable for the spine panel and cover panel to be cut accurately and with precision from one panel to the next. It is desirable that the panel be cut squarely having precise ninety-degree corners with parallel edges. Rectangular cover material traditionally is printed so that it can be centered in relation to the spine panel and cover panels, with a consistent amount of cover material overhang with respect to opposing edges. Often, the center of the cover material sheet is notched in the center at the top and/or bottom so that it can be aligned easily with the spine. If the corners of the spine panel and the cover panels are not square, centering of the cover material in relation to the spine panel and cover panels may be prevented, which may result in a finished hard book cover assembly that is imperfect and which may have to be discarded. For example, the title may not be aligned with the center of the spine on a finished book, or a photograph, border, or other artwork may extend inside the cover when originally designed to be displayed accurately on the outer portion of the cover. Also, it is desirable that the cut edge of a spine panel or cover panel has a flush, straight, and sharp cut along the cutting edge. The cut should be at right angles to the plane of the panel or spine. A mashed or marred edge may result in a damaged book edge or produce a weakened edge that may result in a damaged cover edge during normal handling. It is important that the cut components remain flat. It has been found that existing methods of cutting (shear) expose the components to stresses which leave the cut components warped or twisted. Smaller parts such as spines are most affected by the cut method. Such inaccuracies may not be discovered until after a number of imperfect cover assemblies are produced. This can result in, for example, added costs, significant downtime, or waste.

Due to the ease with which books and manuscripts can be printed using modern technologies, such as digital printing, a need has developed for hard cover book-making machines that can produce small numbers (tens or hundreds, for example) of hard covers for authors and publishers desiring hard covers for their works. Furthermore, as digital printing becomes available in numerous outlets, including copy shops, work places, and even homes, there has developed a need for hard cover book making machines that can be operated in these areas. It is desirable to have the ability for cutting book cover and spine panels with various sizes in small batches or even batches of one. Fast turnaround for books of different shapes, sizes, and thicknesses can be important in operating efficiently with short production runs. Since chipboard or other stock material may come in standard sheet sizes, it may be advantageous for an apparatus to produce various dimensioned spine and cover panels from a standard sheet and to minimize waste. Book producers may find a cost advantage in purchasing greater quantities of chipboard in a standard sheet size rather than purchasing and stocking many varying sizes to match their production needs. In addition to being inexpensive, it may be desired that the spine and cover panel cutting machines require as small an amount of space as possible, be easy to set up, and require minimal skill and training to operate. Space considerations may be of particular interest in those locations with higher real estate expense than traditional publishing companies.

A hard book cover assembly includes cover material, rigid panels, and an adhesive joining the cover material to the panels. The panels may include two cover panels and a spine panel to provide rigidity for the case, with one of the cover panels forming the front of the finished book and the second forming the back. The spine panel provides rigidity to the spine portion of the book. The spine panel and cover panels typically are made of chipboard or other stiff material hereinafter referred to as stock material. The stock material may have dimensions of, for example, a width of 12 inches and a height of 22 inches with a thickness of 0.090 inches. The rigid component is typically a spine panel and two cover panels, although in some applications the spine may be eliminated, and in some instances a single cover panel can be used. As used herein, hard book cover assemblies include book covers (cases), as well as menu covers, calendars, photograph albums, game boards, loose-leaf binders, and other products apparent to those skilled in the art that can be manufactured by affixing cover material to a rigid component. The apparatus described herein may produce hard book cover panels and spines from different types of stock material and may produce panels and spines of different sizes. Runs of a specific size may be as small as one, and adjustment from one size panel to another can take less than one minute or less than 30 seconds.

In one embodiment, the apparatus for making panels may include a transport mechanism to advance a sheet of stock material at a consistent or variable rate through the cutting process and to stop at appropriate positions to allow the horizontal cutter to activate. The transport mechanism may enable the controller to track the position of the sheet of stock material. A vertical cutter receives the stock material and produces vertical cuts of the stock material. "Vertical cuts" refer to cuts in the stock material that are made in the same direction as the stock material is moving. The vertical cuts may include both right side vertical cuts and left side vertical cuts. Vertical cuts typically end up defining the edges of the cover panel that form the top and bottom edges of the book cover, although in some embodiments they can define the left and right edges of the cover, as one looks at the finished book. The location of the vertical cuts may be consistent for a given sheet of stock material, or the location of the cutters can be changed during the process to produce products of varying height from a single sheet of stock material. A horizontal cutter can produce multiple horizontal cuts of the stock material. The horizontal cuts typically end up defining the left and right edges of the front and back cover portions, although in some embodiments the horizontally cut edges can define the top and bottom edges of the book cover. The combination of vertical cuts and horizontal cuts produce properly dimensioned panels. The apparatus is capable of trimming stock material sheets to predetermined sizes in two dimensions in a single pass or machine cycle. The direction of travel of the stock material during the cutting process may be in a single axis and/or a single plane, and vertical and horizontal cuts may be made in the absence of rotation of the stock and/or in the absence of a reverse of direction of the stock. Horizontal cuts also may be made before, after, or during the vertical cut process. In one aspect, the vertical cutter may include one of a right side vertical cutter or a left side vertical cutter. According to this aspect, the vertical cutter may rely on utilizing one straight edge of the stock material and making one vertical cut based on the desired height of the cut panel. In another aspect, the vertical cutter may include both a right side vertical cutter and a left side vertical cutter. According to this aspect, the vertical cutter does not rely on utilizing any straight edges for alignment of the stock material and produces two parallel vertical cuts. The distance between the left side vertical cut and right side vertical cut results in the height of the cut panel. When using two vertical cutters, errors in the alignment and feeding of stock material may be reduced or ignored, because as long as the vertical cutters are aligned, the resulting vertical cuts remain parallel to one another.

In another aspect, the vertical cutter receives the stock material and is capable of varying board "height" dimension with every stock material blank. This may be provided by fixing a right side vertical cutter and/or a left side vertical cutter onto a yoke that allows the vertical cutter(s) to move inward (reducing the height) or outward (increasing the height) from the central portion of the stock material. The yoke may be coupled to a mechanical actuator that allows for automated movement of the vertical cutter(s) in between the feeding of individual stock material blanks. The actuator may be in communication with a controller. In one embodiment, a first stock material blank may produce vertical cut(s) for panels having a height of 9 inches. The position of the vertical cutter may be repositioned prior to the feed of a second stock material blank to produce a vertical cut(s) for panels having a height of 7 inches.

In one aspect, the horizontal cutter receives the stock material and is capable of varying board "width" dimension with every horizontal cut of the stock material. A greater width may be achieved by increasing the time between horizontal cuts as the stock material is fed through the apparatus; correspondingly, decreasing the time between horizontal cuts results in reducing the width of the cut panels. A single sheet of stock material may be processed with multiple cuts to produce multiple panels. For example, a front cover panel, a spine panel, and a back cover panel having the same height may be cut from a single sheet of stock material.

In one aspect, the horizontal cutter also may produce a first truing cut of the stock material followed by subsequent cuts to the desired width. According to this truing cut aspect, errors in the alignment and feeding of stock material may be reduced or ignored since as long as the stock material does not rotate between horizontal cuts, the resulting horizontal cuts will remain parallel to one another, regardless of the original shape of the stock material or the orientation of the stock material with respect to the feed path. The depth of the truing cut from an edge may remove enough material to ensure a complete cut across the sheet of stock material, but not so deep as to waste material unnecessarily.

In one embodiment, the apparatus for making panels may include a transport mechanism to advance a sheet of stock material at a consistent rate throughout the cutting process. The transport mechanism may include two or more pairs of feed rollers that may be used to advance the stock material and maintain a consistent orientation throughout the cutting process. The feed rollers may include twin stabilizing rolls having a gap there between, through which the stock material is advanced in a controlled manner to the cutters. The rollers may include a grip-type surface such as a compressible material such as rubber or silicone. An individual pair of rollers may include a top roller and a bottom roller. The spacing between the top roller and bottom roller may be adjusted to provide a slightly compressive force for greater control of the sheet of stock material. The spacing also may be adjusted to allow for proper feeding of the sheet of stock material. Additionally, the desired spacing may be designed so as to grip without permanently deforming the stock material. For example, a spacing of less than 100 percent of the thickness (e.g., 98 percent of the thickness, 95 percent of the thickness, or 90 percent of the thickness) of the chipboard stock material may result in a proper balance of feed and gripping as the pair of rollers advance sheets of the stock material through the cutting process. This roller spacing may allow for consistent feed rates of the stock material without crushing or distorting the material. It may be important that at least some gap exist between the rollers in order for the rollers to receive the board material as it is fed to the rollers. When the stock material is fed to the rollers, it is not critical that all points on the edge of the material enter the rollers simultaneously, because even if the material is misaligned through the rollers, the vertical and horizontal cutters will cut properly sized panels and spines having ninety-degree corners.

In one aspect, the pair of compression rollers may include an adjustor, such as an electrical or mechanical adjustor, to allow for adjustment of the spacing between rollers. This may include a rotational knob or selector for adjustment of the spacing between rollers, as well as a knob or selector for adjusting the tension or compressive spring force applied by the pair of rollers to the sheet of stock material. The spacing between the rollers can be controlled independently from the compressive force between the rollers. These adjustors may be controlled by a mechanical actuator and automatically controlled by a controller of the apparatus. Additionally, manually actuated adjustors may include instructive labeling or positioning to assist the operator in manually setting the adjustors, for example, adjusting the adjustor to a specified number, angle, or color that is correlated with a specified thickness. This can allow the operator to set the ideal roller spacing by matching indicia on the adjustor to indicia on the stock material or indicia that has been associated with a specific book or book size.

In another aspect, the transport mechanism includes a first pair of rollers for receiving the sheet of stock material from an operator or from a feeder, which can retrieve the sheet from a stock source such as a hopper. The first pair of rollers can receive the stock material via a gravity feed from a hopper or from sheets individually provided by an operator. The sheet of stock material is advanced through the vertical cutter, and the cut stock material is received by a second pair of rollers. The sheet of stock material then advances further to the horizontal cutter. Once a first and second horizontal cut is made, the properly dimensioned panel is dropped into a bin or conveyor for further assembly or storage. The pair of rollers may be mechanically or electronically geared together, as well as with subsequent pairs of rollers. The rollers also may be synchronized to the circular knives of the vertical cutters. This may provide smooth and continuous advancement of the sheet of stock material through the cutting process. Also, it should be understood that embodiments are not limited to two pairs of rollers or the configuration as described according to this aspect. Rollers need not have an uninterrupted surface and may consist of multiple smaller rollers aligned next to each other on a common axis.

In another aspect, a feeder may be configured to retrieve an individual sheet of stock material from a storage tray or hopper. According to this aspect, multiple sheets of stock material may be supplied into a storage tray or hopper by an operator or automated conveyor. The multiple sheets may be of identical or different dimensions. The feeder may include a pivoting arm to transfer sheets from the hopper to the transport mechanism. The arm may include a device for gripping a single sheet of stock material without damaging the material. The gripping device may be, for instance, a vacuum port including one or more suction cups. The vacuum port can couple to a surface of a sheet of stock material located in a stock material storage tray. By grasping the stock material near its central portion, the gripping device can be used with multiple sizes of stock material without requiring repositioning or adjustment. The arm then rotates and transports the individual sheet of stock material onto a guide path for the cutting process. The gripping device may pivot freely on the arm so that the stock material swings freely below the arm as the arm rotates from a first position to a second position. Once in position, the vacuum port releases, and the individual sheet of stock material advances along the guide path, which may be inclined. In another aspect, the guide path includes left and right guide rails that support the bottom left and right edges of the sheet of stock material. The left and right guide rails also include vertical side portions that aid in centering the sheet of stock material. The left and right guide rails may be on an incline, allowing for gravity to advance the sheet of stock material into the transport mechanism as the sheet of stock material is released from the vacuum port. The individual feeder allows for the controlled feeding of individual sheets of stock material into the cutting process. In other examples, the individual feeder is not limited to an arm with a vacuum port. In this example, the storage tray is located above the guide rails, and a mechanical actuator grabs a bottom sheet of stock material stacked in the storage tray. The actuator pushes the sheet through a slot in a bottom edge of the storage tray and onto the guide path.

In another aspect, the feeder may utilize an inclined product path for simplified in-feed and out-feed. As previously described, the guide path may use rails to allow for gravity to pull a sheet of stock material down guide rails and into a transport mechanism. The stock material may advance down the inclined product path, where waste falls off the product path, and gravity is again used to advance the final cut panels to a desired storage for future processing.

In one aspect, the vertical cutter, horizontal cutter, feeder, transport mechanism, and waste separator each may be controlled by a controller, such as a Galil model DMC 4080, available from Galil, Rocklin, Calif. The same controller may be used to communicate with other components of the apparatus and to coordinate other operations. Connection to various actuators and programming of the controller may be performed readily by those skilled in the art. In another aspect of the apparatus, the vertical cutter, horizontal cutter, and transport mechanism may be associated with other components of the apparatus. The vertical cutter, horizontal cutter, feeder, transport mechanism, and waste separator may be associated with a framework that also may be associated with other components. Two items or components are associated with each other if there is a structural, interdependent interrelationship between the two. Two items may be associated with each other if they are, for example, fastened, supported, fixed, resting, hinged, integral, in contact, or connected or removably connected with or to each other. Two items also may be associated with each other if they are each associated with a third component.

In another embodiment, the vertical cutter may be a pair of circular, rotating knives. One or more motors may be used to rotate the pair of circular blades. The upper and lower blades may operate in a common plane, but cutting surfaces of the blades of the pair of circular knives may be spaced a distance apart to produce both a cutting and crushing action on the sheet of stock material. The cutting edge of the blades also may include wedge-shaped cutting surfaces that can serve to apply lateral pressure to the scored area as the blade slices into the stock material. The blades may cut the stock material from the upper surface, the lower surface, or both, and may cut less than the full thickness of the stock material. For example, the knives may cut less than 95%, less than 90%, less than 80%, or less than 70% of the thickness of the stock material. This means that the space between the blades may be, for example, 0.001, 0.003, 0.004, 0.005, or 0.009 inches. Alternatively, the space may be greater than 0.001, 0.003, 0.004, 0.005, or 0.009 inches. In other embodiments, the spacing between the blades may be less than the thickness of the stock material. The combination of top and bottom blades produces a respective top and bottom cut while simultaneously causing a crushing action on the stock material as it is fed through the opposed knives. This crushing action causes the chipboard to burst apart the remaining uncut fibers connecting the material on each side of the knife. The resulting cut produces a cleaner edge with less fraying of material and without a burnt or blackened edge as would result from a laser cutting process. In addition, the pair of circular, rotating knives may provide reduced forces in both the product and equipment relative to a shear cut or compression cut against an anvil. Since the knives are never in contact with each other during the cutting process, the time between knife replacement is increased. In some embodiments, the top and bottom blades are rotated in opposing directions. For example, the top blade may rotate in a clockwise direction while the bottom blade rotates in a counterclockwise direction. The direction of rotation of the knives may be opposed to the direction of travel of the stock material or may be in the same direction as the travel of stock material. As previously described, a right side pair of circular, rotating knives and/or a left side pair of circular, rotating knives may be coupled to a yoke that allows vertical cutter(s) to move inward (reducing the panel height) or outward (increasing the panel height).

In another embodiment, the horizontal cutter may be activated via a toggle linkage. The horizontally oriented straight blade may be moved toward and compressed against an anvil producing a crushing, cutting action as the linkage is rotated. According to one aspect, a pneumatic actuator may be used to rotate a toggle linkage using leverage to compress a straight blade into the sheet of stock material and against an anvil located beneath the sheet of stock material. The speed of the cutting may be made swift enough to only slightly delay advancement of the sheet of stock material. In this aspect, the straight blade of the horizontal cutter may extend across the sheet of stock material and apply even pressure directly perpendicular to the plane of the sheet.

In this case, the perpendicular cutting action does not produce stress that can cause rotation or twisting of panels or spines. It should be understood that both the horizontal cutter and the vertical cutter are not limited to a straight cut or a shaped cut or to a single angle along the cutting line. Examples of a cutter may include, but are not limited to, a blade, a laser, a water jet, a saw, a hot wire, scissors, and a stamp. The cutter may be powered and/or activated in any number of ways, including, but not exclusively, pneumatically, mechanically, hydraulically, magnetically, or electrically.

In another embodiment, a waste separator may be used to separate the cut panels from scrap waste produced by cutting the sheet of stock material. According to one aspect, a panel receiver, for example, but not limited to, guide rails, a conveyor belt, or other type of panel tray/conveyor receives the panel, and the cut waste portion falls to the right and/or left of the panel receiver. The receiver may include two conveyor belts spaced apart by a distance smaller than the height of the resulting panel and spine portions. Waste bins may be located beneath and to the right/left of the panel receiver to facilitate the removal of waste material. According to another aspect, a panel receiver is located beneath the horizontal cutter and receives the panels and waste material as it is cut and exits the horizontal cutter. According to one aspect, the panel receiver is a conveyor belt with a controller designed to advance the panels in one direction and to advance the waste material in another direction. In this example, the conveyor belt may reverse direction to advance the belt backwards in order to dump the waste material in a waste bin located at the end of the conveyor. The conveyor belt may advance the belt in a forward direction, moving the cut panels on for further process. In other examples, the waste separator may be a mechanically actuated arm or tray that redirects the waste material or cut panels. The waste separator may be capable of delivering panel components as a kit, for example, as including two cover panels and a spine panel with the waste portions removed. In another example, the conveyor belt may have a width narrower than the minimum height of the smallest book cover panel to be produced by the cutting machine. This allows the cover panels and spine panel to land on the conveyor belt while scrap material of the vertical cutter falls to the sides of the conveyor belt. Waste bins may be used to collect scrap material and may be located to the sides of the conveyor belt. As the stock material is under the control of at least one pair of rollers during the cutting process, the apparatus can keep track of the position of the sheet. This allows for accurate cutting and provides spatial information that tells the controller when a particular cut portion is being passed to the conveyor. If the cut portion is a waste portion, then the conveyor is instructed to run in reverse. If the cut portion is a panel or spine, then the conveyor is instructed to run in a forward direction.

In another embodiment, the apparatus may include a controller for directing the various components of the cutting apparatus, including, but not limited to, the feeder, transport mechanism, vertical cutters, the horizontal cutters, the gripping device, and the waste separator. The controller may be, for example, a microprocessor or computer. A controller may include several known components and circuitry, including a processing unit (i.e., processor), a memory system, input and output devices, and interfaces (e.g., an interconnection mechanism), as well as other components, such as transport circuitry (e.g., one or more busses), a video and audio data input/output (I/O) subsystem, and special-purpose hardware, as well as other components and circuitry, as described below in more detail. Further, the controller may be a multi-processor computer system or may include multiple computers connected over a computer network. In one aspect, the controller is capable of minimizing waste by calculating of the optimal footprint for producing multiple panels where more component panels can be cut from a single sheet of stock material than are required for one book. In another aspect, the controller may be capable of providing panels for a single book which may require multiple sheets of stock material to produce the complete set of panels for the book. In one aspect, the controller may be capable of minimizing "cover material" waste by alerting an operator of an inappropriate blank chipboard size or some other limitation in downstream equipment, before the cover material has had adhesive applied. The controller also may determine identifying indicia that are to be printed or stamped onto spine or panel portions.

The controller may include a processor, such as a commercially available processor, including, for example, one of the series x86, Celeron and Pentium processors, available from Intel, similar devices from AMD and Cyrix, the 680X0 series microprocessors available from Motorola, and the PowerPC microprocessor from IBM. Many other processors are available, and the computer system is not limited to a particular processor. A processor typically executes a program called an operating system, of which Windows, UNIX, Linux, DOS, VMS, MacOS and OS8 are examples, which controls the execution of other computer programs and provides scheduling, debugging, input/output control, accounting, compilation, storage assignment, data management, memory management, communication control, and related services. The processor and operating system together define a computer platform for which application programs in high-level programming languages are written. The controller used herein is not limited to a particular computer platform.

The controller may include a memory system, which typically includes a computer readable and writeable non-volatile recording medium, of which a magnetic disk, optical disk, a flash memory, and tape are examples. Such a recording medium may be removable, for example, a floppy disk, read/write CD, or memory stick, or may be permanent, for example, a hard drive.

Such a recording medium stores signals, typically in binary form (i.e., a form interpreted as a sequence of one and zeros). A disk (e.g., magnetic or optical) has a number of tracks, on which such signals may be stored, typically in binary form, i.e., a form interpreted as a sequence of ones and zeros. Such signals may define a software program, e.g., an application program, to be executed by the microprocessor, or information to be processed by the application program.

The memory system of the controller also may include an integrated circuit memory element, which typically is a volatile, random access memory such as a dynamic random access memory (DRAM) or static memory (SRAM). Typically, in operation, the processor causes programs and data to be read from the non-volatile recording medium into the integrated circuit memory element, which typically allows for faster access to the program instructions and data by the processor than does the non-volatile recording medium.

The processor generally manipulates the data within the integrated circuit memory element in accordance with the program instructions and then copies the manipulated data to the non-volatile recording medium after processing is completed. A variety of mechanisms are known for managing data movement between the non-volatile recording medium and the integrated circuit memory element, and the controller that implements the methods, steps, systems, and system elements described hereinare not to be considered limiting in any way. The controller is not limited to a particular memory system.

At least part of such a memory system described above may be used to store one or more data structures (e.g., look-up tables) or equations. For example, at least part of the non-volatile recording medium may store at least part of a database that includes one or more of such data structures. Such a database may be any of a variety of types of databases, including, for example, a file system having one or more flat-file data structures where data is organized into data units separated by delimiters, a relational database where data is organized into data units stored in tables, an object-oriented database where data is organized into data units stored as objects, another type of database, or any combination thereof.

The controller may include a video and audio data I/O subsystem. An audio portion of the subsystem may include an analog-to-digital (A/D) converter, which receives analog audio information and converts it to digital information. The digital information may be compressed using known compression systems for storage on the hard disk to use at another time. A typical video portion of the I/O subsystem may include a video image compressor/decompressor, of which many are known in the art. Such a compressor/decompressor converts analog video information into compressed digital information, and vice-versa. The compressed digital information may be stored on hard disk for use at a later time.

The controller may include one or more output devices. Example output devices include a cathode ray tube (CRT) display, liquid crystal displays (LCD), touch screen display, and other video output devices, as well as printers, communication devices such as a modem or network interface, storage devices such as disk or tape, and audio output devices such as a speaker.

The controller also may include one or more input devices. Example input devices include a keyboard, keypad, track ball, mouse, pen and tablet, touch screen, and any communication devices such as those described above, and data input devices such as audio and video capture devices and sensors. The controller is not limited to the particular input or output devices described herein.

The controller may include specially programmed, special-purpose hardware, for example, an application-specific integrated circuit (ASIC). Such special-purpose hardware may be configured to implement one or more of the methods, steps, simulations, algorithms, systems, and system elements described above.

The controller and components thereof may be programmable using any of a variety of one or more suitable computer programming languages. Such languages may include procedural programming languages, including, for example, C, Pascal, FORTRAN and BASIC, object-oriented languages, for example, C++, Java, and Eiffel, and other languages, such as a scripting language or even assembly language.

The methods, steps, simulations, algorithms, systems, and system elements may be implemented using any of a variety of suitable programming languages, including procedural programming languages, object-oriented programming languages, other languages, and combinations thereof, which may be executed by such a computer system. Such methods, steps, simulations, algorithms, systems, and system elements can be implemented as separate modules of a computer program or can be implemented individually as separate computer programs. Such modules and programs can be executed on separate computers.

The methods, steps, simulations, algorithms, systems, and system elements described above may be implemented in software, hardware, firmware, or any combination of the three, as part of the controller described above or as an independent component.

Such methods, steps, simulations, algorithms, systems, and system elements, either individually or in combination, may be implemented as a computer program product tangibly embodied as computer-readable signals on a computer-readable medium, for example, a non-volatile recording medium, an integrated circuit memory element, or a combination thereof. For each such method, step, simulation, algorithm, system, or system element, such a computer program product may comprise computer-readable signals tangibly embodied on the computer-readable medium that define instructions, for example, as part of one or more programs, that, as a result of being executed by a computer, instruct the computer to perform the method, step, simulation, algorithm, system, or system element.

In another embodiment, the controller of the apparatus may communicate between the panel cutting apparatus and other machine components in, for example, a book production work cell including various other machines for manufacture of a hardcover book. In one aspect, the controller may communicate between, for example, but not limited to, a cover material trimmer, a flexible spine trimmer, a headband trimmer, a case-maker, a casing-in machine, a building-in machine, and/or a storage/retrieval book component coordinator. In another aspect, the controller may be capable of receiving dimensional data from a computer file and executing a cut cycle with or without operator input. In another aspect, the controller may be capable of receiving "book block" dimensions and determining actual component dimensions and quantities required. The controller may be capable of scanning a product related marking such as a barcode to determine/retrieve dimensional data.

The controller also may be capable of printing or stamping a product related barcode or other information on a cut panel or spine to store and transmit dimensional data or other details such as component identification. For instance, cover material used to produce a specific book may be tagged, stamped, or printed with indicia, such as a bar code or ID #, so that the respective parts may be retrieved easily and accurately when desired. The indicia may associate a spine or panel or both with a particular size book block, with a particular book title, or with an ISBN number, or may simply identify the dimensions, e.g., height, width, and thickness of the particular components. The indicia may be identical to, or associated with, indicia that are on a book block or cover material. As the apparatus is aware of the dimensions of the stock being produced, these dimensions can be correlated with stamped or printed indicia that, via a database, can tie various parts of the finished book together. The apparatus also may have a reader, such as a bar code reader, that can read a bar code or other indicia on an order sheet, cover material, spine, panel, data file, etc. The apparatus then may use this information to set the dimensions of the knives in order to cut stock to the appropriate size for the desired product. All size information may be stored on board the apparatus or may be retrieved from a remote or local database. Software to perform reading, printing, cutting, and associating of various components can be stored on a computer readable medium such as a hard drive, flash memory, or optical disk.

Printing of panels and spines may be completed on board the apparatus or prior to, or after, feeding the stock material to the apparatus. The apparatus may include a printer, such as an inkjet or laser printer. As the apparatus can track the position of the stock material and as the apparatus is aware of the position of the cuts to be made, the apparatus also can be programmed to print indicia on the panels or spines prior to cutting the panels or spines from the stock material. For example, bar codes may be printed at six different positions on a sheet of stock material. The bar code, or other indicia, can include information such as the dimensions of the spine and panels to be cut for a specific book. The same bar code can also include information regarding specific cover or book block data. Thus, the same bar code can be printed on panels, spines, cover material and/or book blocks for a specific book. After four panels and two spines are cut from the stock material, each cut component will include a bar code at a predetermined location. Alternatively, indicia can be printed on individual components after they are cut.

FIG. 1 provides a perspective view of a cutting apparatus 100 according to an exemplary embodiment of the invention. As viewed in FIG. 1, a sheet of stock material is passed from top left to bottom right during the cutting process. The apparatus 100 may include a storage tray 102 on which multiple sheets of stock material are placed in preparation for the cutting process. A feeder, such as arm 104 with a vacuum port 106, may be used to individually feed sheets and initiate the feeding of the sheet of stock material into the cutting process. The vacuum port 106 is pivotally mounted on horizontal rod 126 so that it may be rotated by a pulley system as it passes through an arc from tray 102 to guide rails 110. The vacuum port 106 couples to a top surface of a sheet of stock material located in a stock material storage tray 102. The arm 104 rotates upwardly and away from tray 102 through about 100 degrees and transports the individual sheet of stock material from tray 102 onto a guide path 108 for the cutting process. The vacuum port may be positioned to grab the stock material below its center of gravity so that it rotates as arm 104 lifts it up from the stack. The pulley system is in communication with the controller and can rotate the vacuum port so that it is flush with the stock material at pickup. As the arm extends through its arc, the vacuum port is rotated so that the stock material can be deposited onto guide rails 110. The end of the material that was positioned highest in tray 102 will be the end of the material that enters the apparatus first. The stock material may be transported from tray 102 to the guide path 108 without passing outside of the footprint of the apparatus. This configuration also minimizes the amount of travel (and space) required by arm 104 because the stock material is positioned on the outside, facing away from the arm 104, at both the beginning and the end of the transfer. Once the vacuum port 106 releases, the individual sheet of stock material advances along the guide path 108. In another aspect, the guide path 108 includes left and right guide rails 110 that support the bottom left and right edges of the sheet of stock material. The left and right guide rails 110 also include side portions that aid in centering the sheet of stock material. The left and right guide rails 110 are on an incline allowing for gravity to advance the sheet of stock material into the transport mechanism as the sheet of stock material is released from the vacuum port 106. The transport mechanism, in this case twin stabilizing rollers 202, can start transporting (rotating) when the stock material reaches the rollers. Alternatively, the rollers may be rotating prior to contact with the rollers, and the acceptance of the stock material can be signaled by, for example, a change in the separation distance between the rollers or a separate sensor, such as a laser. Once through the cutting process the cut panels and scrap cut material exit the cutting machine 100 at the exit portion 112. From the exit portion 112, the cut panels and scrap cut material may be separated and transported for further processing.

The cutting machine 100 may include various protective panels 114 to prevent exposure of the cutting blades and rollers of the cutting machine. The protective panels 114 may incorporate triggers or other features to prevent operation of the cutting machine 100 when the protective panels 114 are removed or in an open position for possible maintenance. The cutting machine 100 also may incorporate framing and supporting to hold the various components of a controller, operator input/output devices, or networking components, including, but not limited to, a keyboard, mouse, bar code scanners, displays, alert lights and sirens, microprocessors, and antennas. The cutting machine 100 may be provided in a compact housing minimizing floor space, as well as incorporating wheels or rollers 118 to facilitate moving and/or easy storage. In another aspect, the apparatus for making panels may be configured to operate in a small area. This may be of particular interest to producers of lower numbers of, for example, hard book covers or hard cover books. A number of manufacturing procedures may be performed in a limited space. For example, the apparatus may include a cover material assembler or binder and be operable in less than 200, less than 100, or less than 50 square feet of space.

Figure 2:
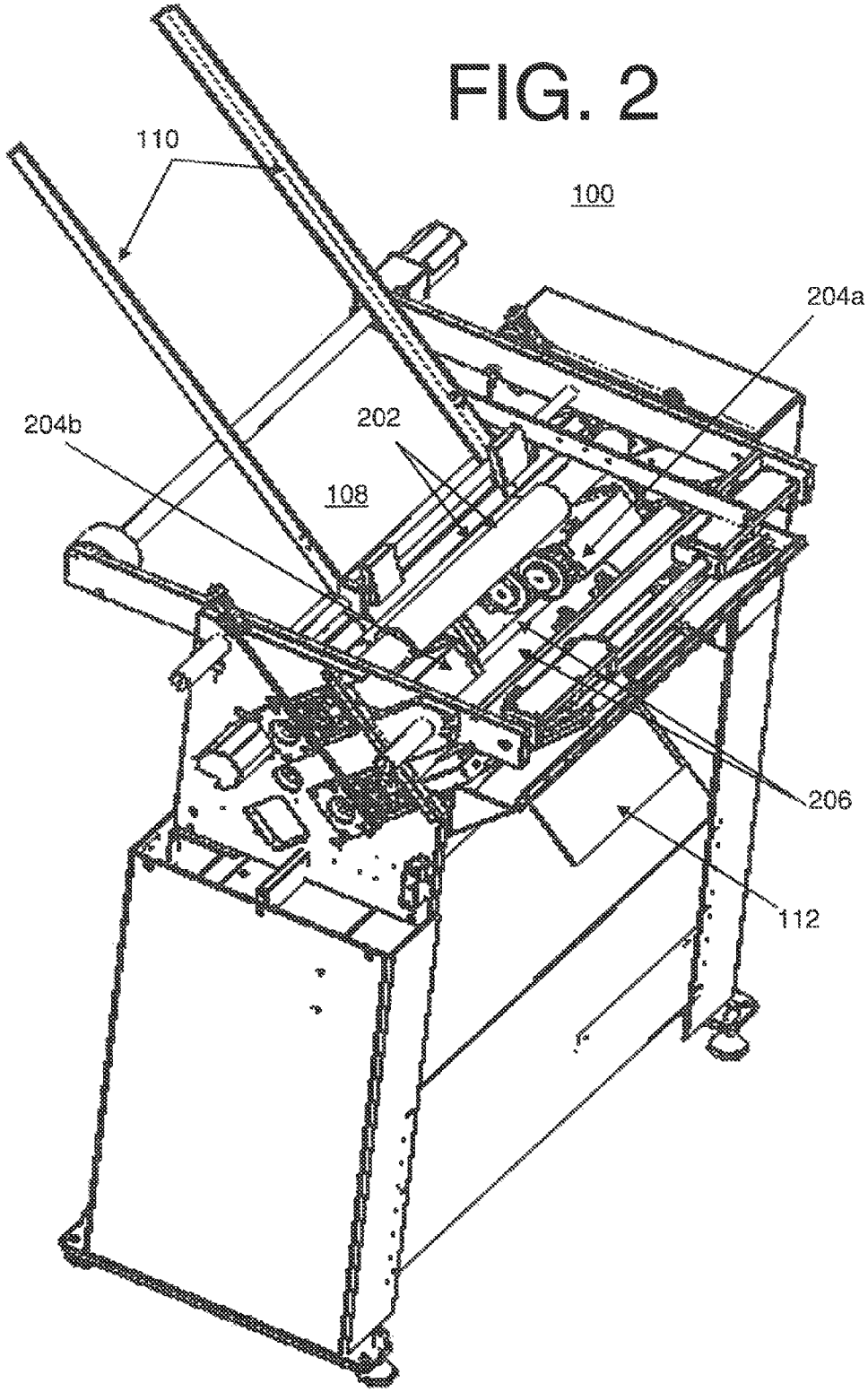
FIG. 2 is a perspective view of the cutting apparatus according to the exemplary embodiment of the invention with some of the protective/outer panels removed.

FIG. 2 provides perspective view of a cutting machine 100 according to an exemplary embodiment of the invention with some of the protective/outer panels removed. The cutting machine 100 may include a transport mechanism which may include one or more pairs of feed rollers to advance the stock material and maintain a consistent orientation through the cutting process. The transport mechanism may include a first pair of rollers 202 for receiving the sheet of stock material. The first pair of rollers 202 may receive the stock material via a gravity feed of the sheet as the sheet enters the first pair of rollers 202. The first and second pair of rollers 202, 206 may include a mechanical adjustor 304 to allow for adjustment of the spacing between rollers. The mechanical adjustor 304 may use a wedge to force each individual roller further apart while a compressive spring pushes the individual rollers together. The mechanical adjustor 304 may be placed on both sides of the rollers to allow proper and even adjustment of both sides of the roller. The sheet of stock material is advanced through the vertical cutter 204 (two pairs of circular knives, 204*a* and 204*b*) and received by a second pair of rollers 206. The sheet of stock material further advances through the horizontal cutter (as shown in FIG. 3). Once a first and second horizontal cut is made, the properly dimensioned panel may be dropped from the exit portion 112 into a bin or conveyor for further assembly. In instances where the position of the circular knives is to be adjusted during the process, the knives may be temporarily separated from each other by a distance greater than the thickness of the stock material being cut. This can allow the knives to be moved while the stock material remains in place.

Figure 3A:
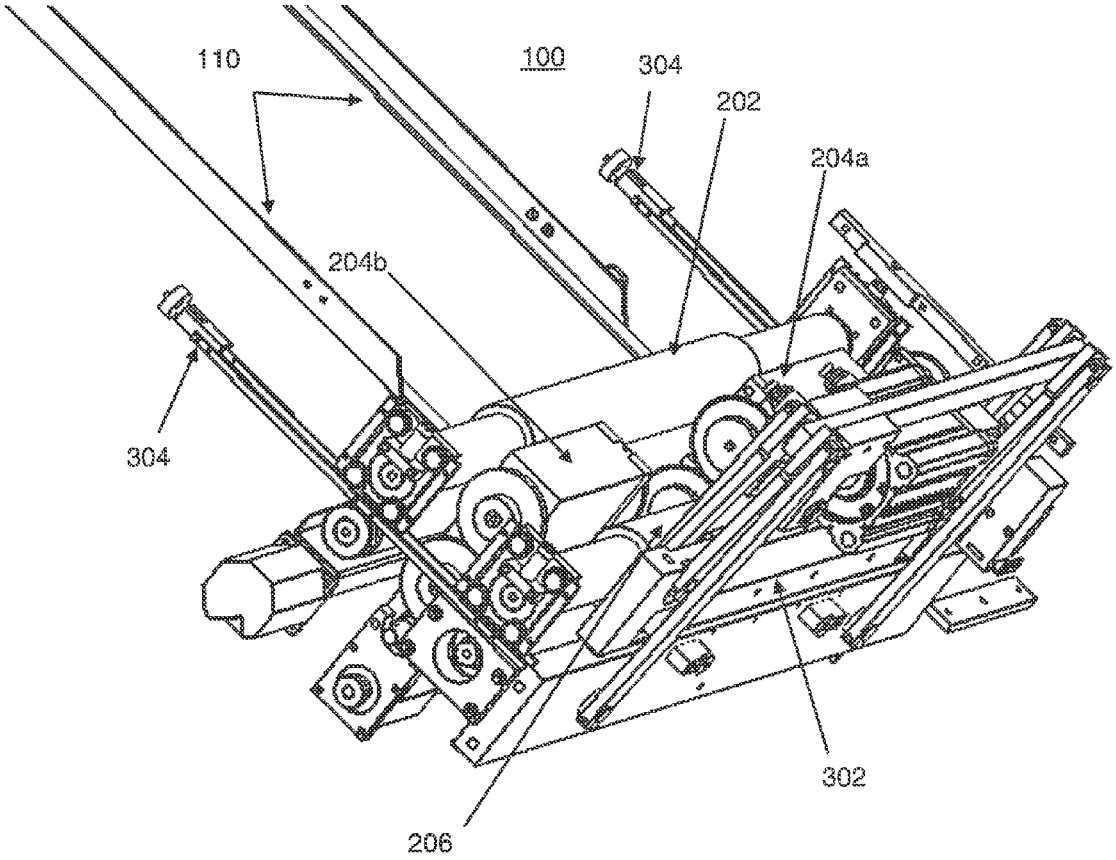
FIGS. 3A and 3B are perspective views of the interior components of the cutting apparatus according to the exemplary embodiment of the invention.
Figure 3B:
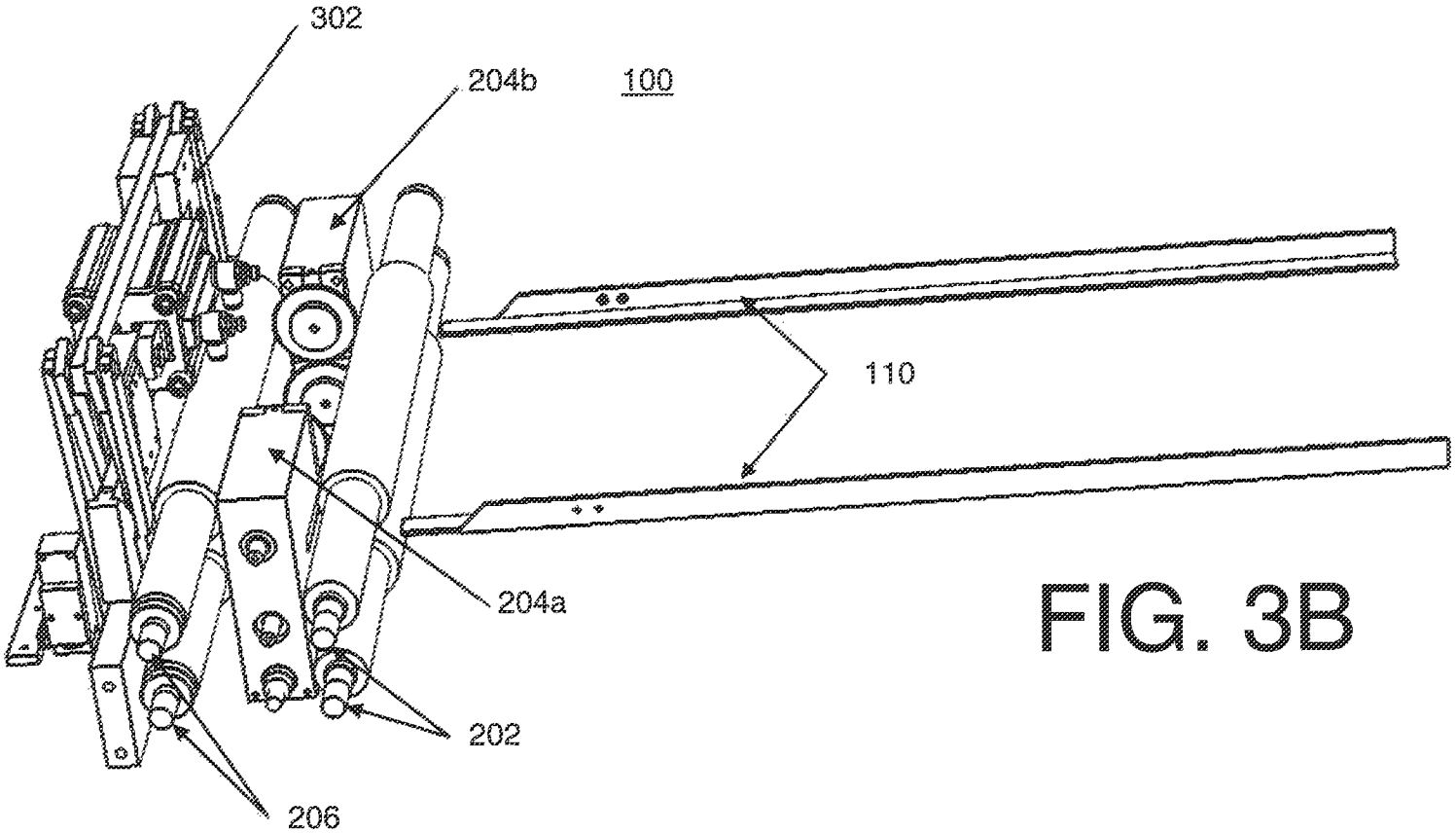

FIGS. 3A and 3B provide perspective views of the interior components of the cutting machine 100 according to an exemplary embodiment of the invention. The pair of rollers 202 and 206 may be mechanically or electronically geared to each other as well as to the vertical cutter 204 (as previously noted, two pair of circular knives, 204*a* and 204*b*). This may provide smooth and continuous advancement of the sheet of stock material through the cutting process. The first and second pair of rollers 202, 206 may provide two pairs of twin stabilizing rollers. The second pair of rollers 206 may feed the sheet of stock material through the horizontal cutter 302. The horizontal cutter 302 may use a toggle action with a straight blade. A motor or actuator may rotate the toggle linkage and compress the straight blade against an anvil to produce a straight cut horizontally on the sheet of stock material (as shown in greater detail in FIGS. 7A and 7B).

Figure 4:
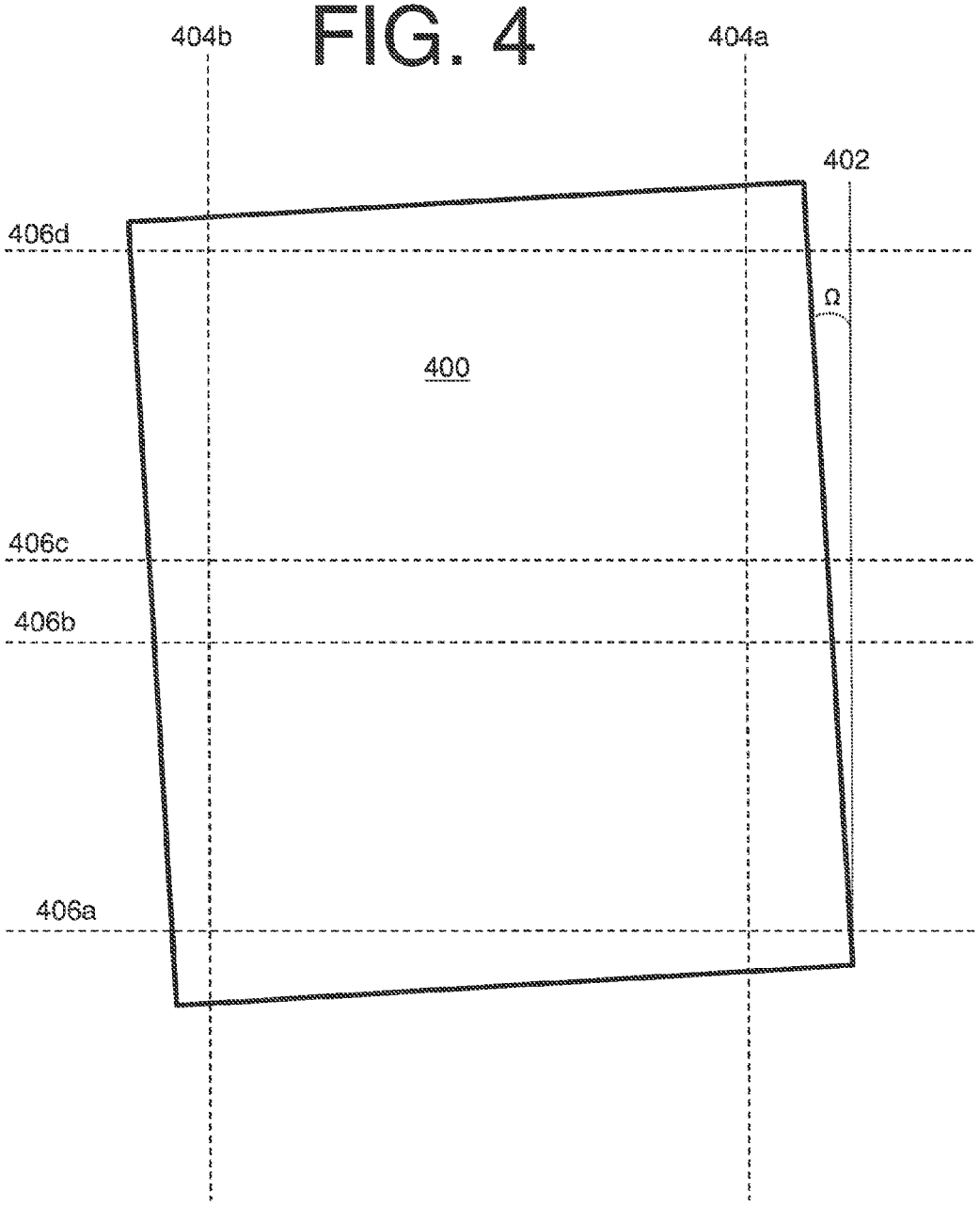
FIG. 4 is a diagrammatic top plan partial view of a sheet of stock material in relation to a cutting axis of the cutting apparatus according to an exemplary embodiment of the invention.

In FIG. 4, the sheet 400 of stock material has been skewed in relation to cutting axis 402 of the cutting machine 100 by an angle Ω. This may occur, for example, when all points on the leading edge of the stock material do not enter the rotating rollers at exactly the same time. When the sheet 400 of material is not centered or is skewed (out of alignment by Ω) with respect to the cutting axis 402, the cutting process may compensate for imperfections in the alignment during the feed process. The cutting process also may compensate for damaged edges or non-squared edges of the stock material as provided from the supplier. This may result in, for example, less scrap and greater efficiency. The vertical cutter produces two vertical cuts—a right side vertical cut 404*a* and a left side vertical cut 404*b*. As long as the blades of the right vertical cutter 204*a* and the left vertical cutter 204*b* are aligned, the resulting cut edges 404*a* and 404*b* will be parallel. The horizontal cutter 302 also may produce a first truing cut 406*a* of the stock material followed by subsequent cut 406*b* to the desired width of the first cover panel. The horizontal cutter 302 then produces subsequent cuts 406*c* and 406*d* to produce the spine cover and the second cover panel. According to this truing cut aspect, the resulting horizontal cuts will remain parallel to one another as long as the sheet 400 travels along a fixed axis perpendicular to the rollers after the first cut is made. Once the rollers 202 and/or 206 have gripped the stock material, it will not rotate and will be fed along a consistent pathway. The apparatus also may be positionally aware in its handing off from one set of rollers to another set of rollers so that the position of the stock material is known at all times.

Figure 6:
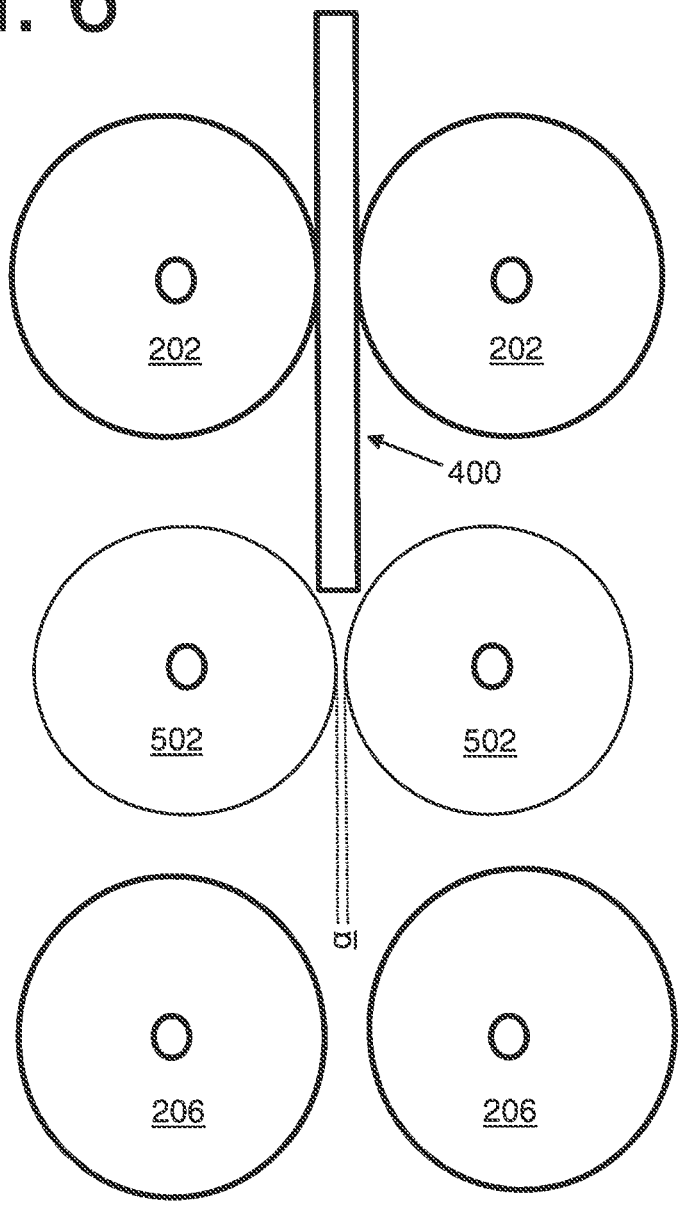
FIG. 6 is a diagrammatic profile view of the vertical cutter and the transport mechanism of the cutting apparatus according to the exemplary embodiment of the invention.

FIGS. 5A, 5B, and 6 provide perspective view of the vertical cutter 204*a* and 204*b* of the cutting machine 100 according to an exemplary embodiment of the invention. The vertical cutter 204*a* and 204*b* may be a pair of circular, rotating blades 502. One or more circular blades may be rotated by motor 504. The motors 504 may be mechanically or electrically geared to one another. For example, the vertical cutter 204*a* and 204*b* may be geared together through/within a yoke 205. The individual motors 504 of each pair also may operate in opposite directions, reducing the twisting and shifting forces produced by the cutting action. The blades 502 of the pair of circular knives may be spaced a distance a apart. The distance a may be 5% of the thickness of the sheet of stock material. The spacing of the blades 502 produces both a cutting and crushing action of the sheet of stock material 400. As previously discussed, each of the right side pair of circular, rotating knives 204*a* and the left side pair of circular, rotating knives 204*b* may be coupled to a movable yoke 205 that allows vertical cutter(s) to move inward (reducing the height) or outward (increasing the height).

Figure 7A:
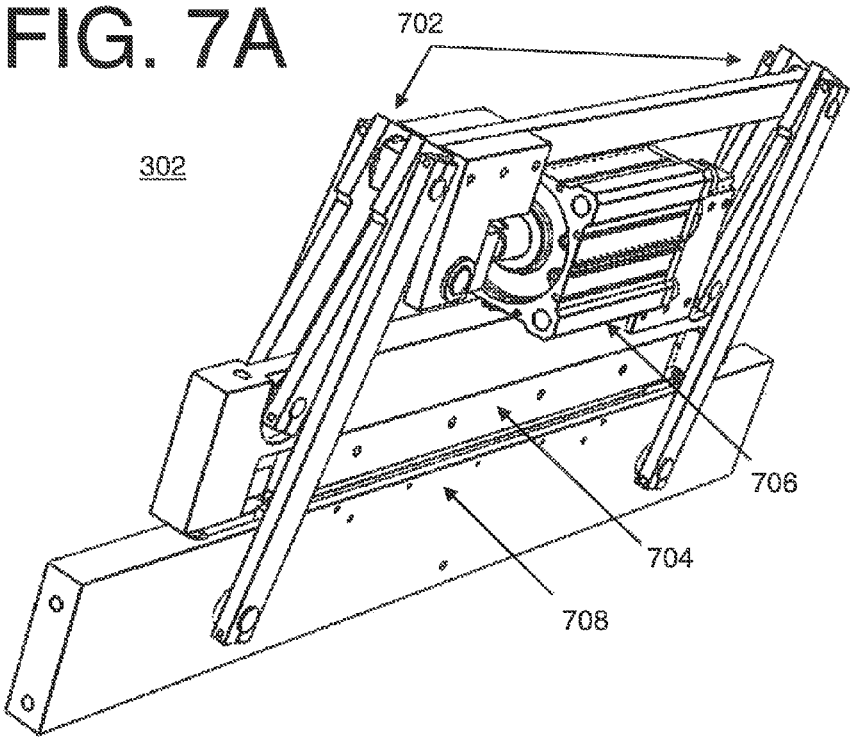
FIG. 7A is a perspective view of the horizontal cutter of the cutting apparatus according to the exemplary embodiment of the invention.
Figure 7B:
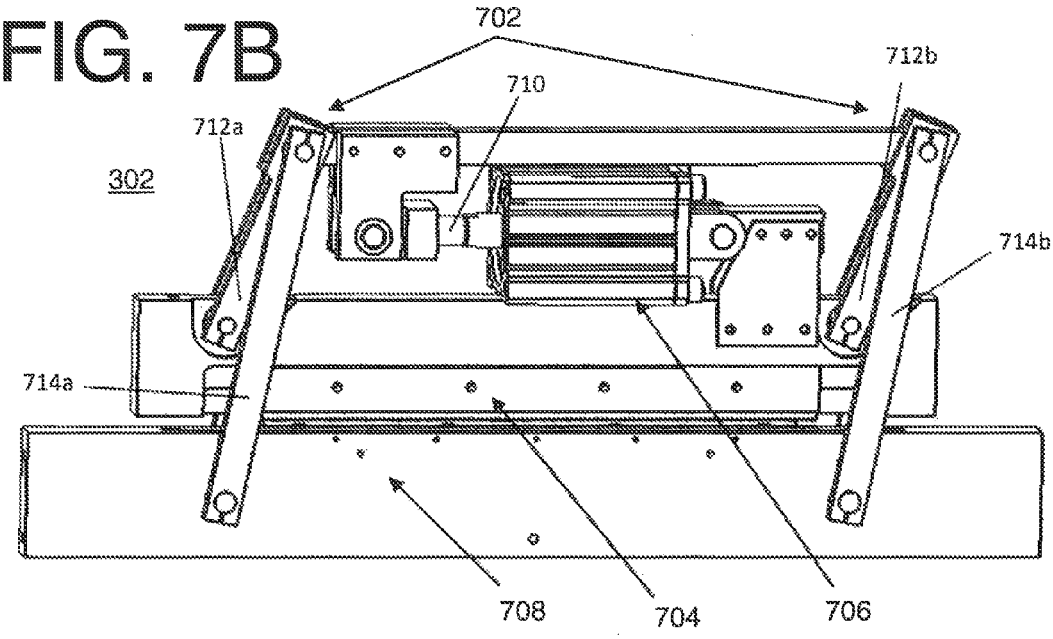
FIG. 7B is a profile view of the horizontal cutter of the cutting apparatus according to the exemplary embodiment of the invention.

FIGS. 7A and 7B provide perspective views of the horizontal cutter 302 of the cutting machine 100 according to an exemplary embodiment of the invention. The horizontal cutter 302 may use a toggle linkage 702 with a straight blade 704. A pneumatic actuator 706 may be used to rotate the toggle linkage 702 using leverage of the toggle to compress the straight blade 704 into the sheet of stock material and against an anvil 708 located beneath the sheet of stock material. As actuator 706 extends piston 710 outwardly, short arms 712*a* and 712*b* each move outwardly and become closer to parallel with their linked long arms 714*a* and 714*b*, resulting in a lowering of blade 704. As the straight blade 704 is compressed against an anvil 708, a crushing, cutting action produces a straight cut on the sheet of stock material. The mechanical actuator 706 rotates the toggle linkage 702 in the opposite direction and withdraws pistons 710*a* and 710*b*. The straight blade 704 releases the sheet of stock material from being compressed against the anvil 708. The sheet then can advance further through the horizontal cutter 302. The process is repeated for subsequent cuts. The speed of the cutting may be produced quickly enough to only slightly delay advancement of the sheet of stock material. As the straight blade evenly extends along the advancing edge of the sheet of stock material and is directly perpendicular to the direction of the sheet advancement, the cutting action of the horizontal cutter may not produce a rotating or shafting action as the sheet of stock material is cut horizontally.

Figure 8:
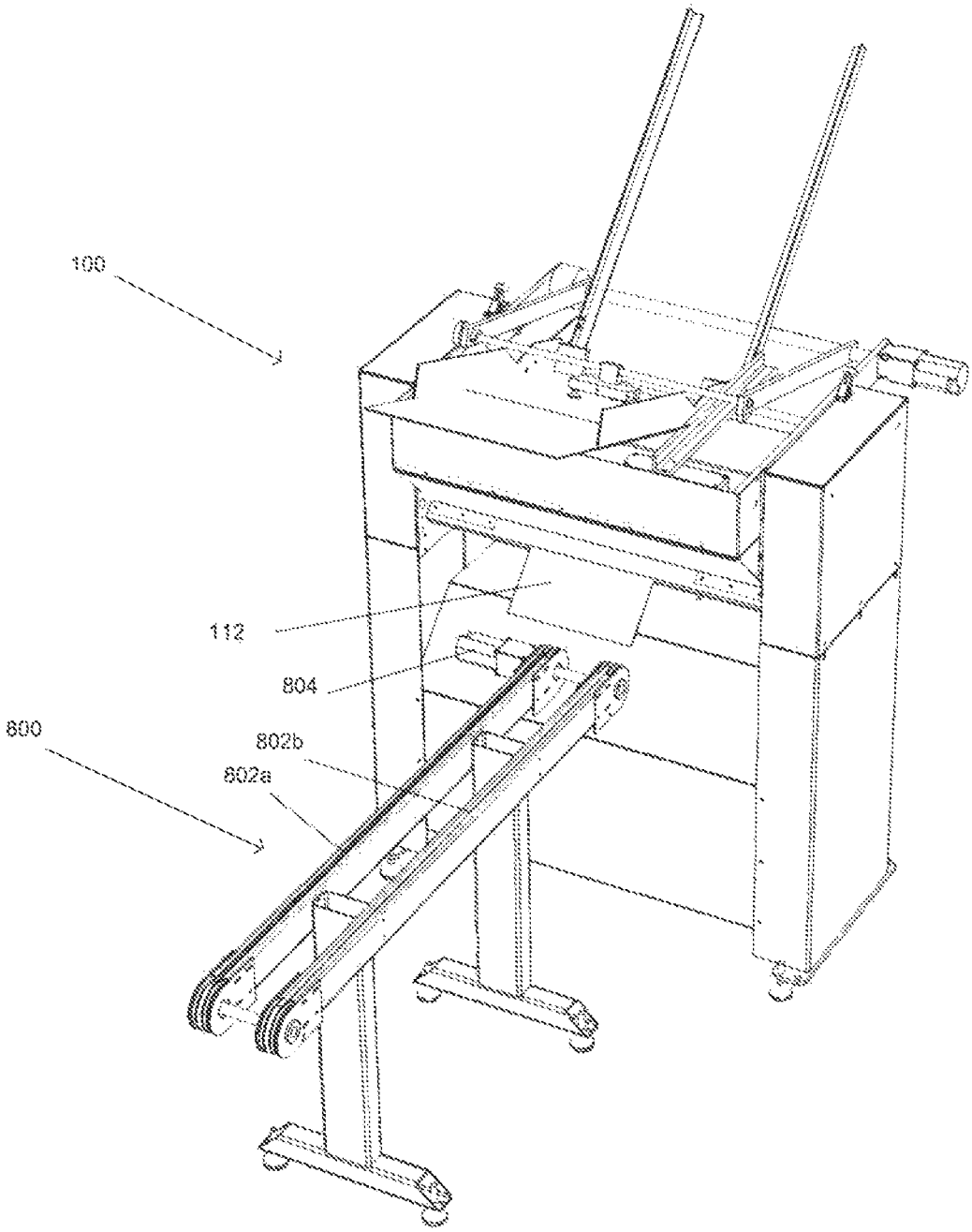
FIG. 8 is a perspective view of a conveyor belt 800 at the exit portion 112 of the cutting machine 100.

FIG. 8 is a perspective view of a conveyor belt 800 at the exit portion 112 of the cutting machine 100. According to an exemplary embodiment of the invention, the conveyor belt 800 may include two rotating belts 802*a* and 802*b*. The rotating belts 802*a* and 802*b* may be powered by motor 804. The motor may be controlled by the controller of the cutting machine 100. Once through the cutting process, the cut panels and scrap cut material exit the cutting machine 100 at the exit portion 112. The rotating belts 802*a* and 802*b* may be located underneath the exit portion 112. The width of each belt and distance between each belt 802*a* and 802*b* may be designed to allow the scrap cut material from the vertical cuts to pass between or to either side of the belts 802*a* and 802*b*. The cut panels and scrap cut material from the horizontal cut may be received by the belts 802*a* and 802*b*. The controller of the cutting machine 100 may direct the belts 802*a* and 802*b* to advance forward or backward based on the understood cutting process. The angular position of the rollers can be interpreted by the controller to indicate how far the stock material has been advanced and, as a result, can be used to indicate what portion of the material is being fed from exit portion 112. For example, after a horizontal truing cut, the belts 802*a* and 802*b* may advance backward causing the scrap material of the truing cut to fall to the rear of the conveyor belt 800. With the horizontal truing cut, scrap material may fall into a bin along with vertical cut scrap material. The bin may be located underneath the exit portion 112 and to the rear of the conveyor belt 800. When the horizontal cut is understood to be producing a cut panel, the belts 802*a* and 802*b* may advance in a forward direction, advancing the cut panel to the front of the conveyor belt 800 to another station for further processing or to a storage bin. Embodiment of the conveyor belt 800 may allow the cut panels to be separated and transported for further processing.

Figure 9:
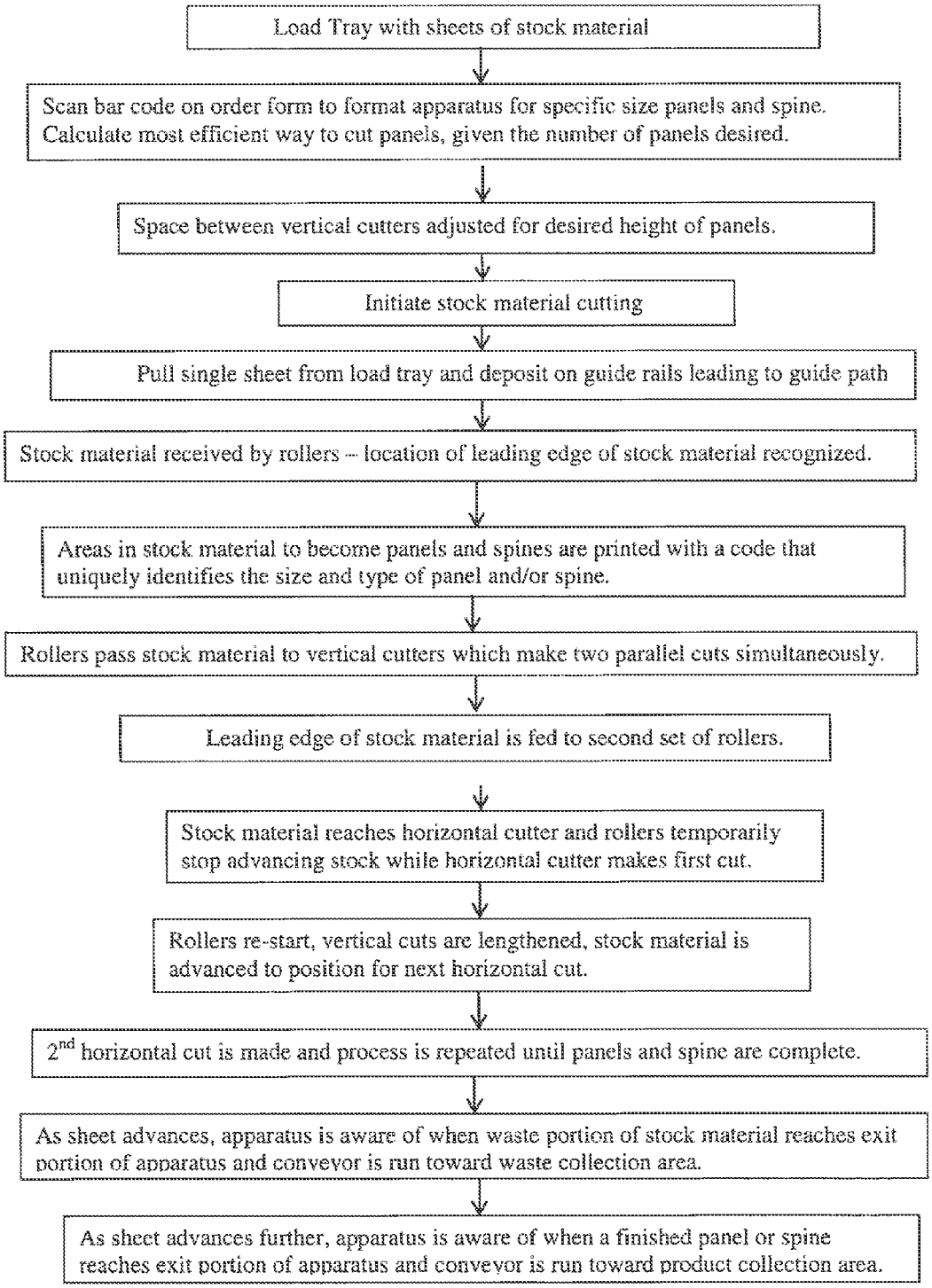
FIG. 9 provides a flow chart illustrating one embodiment of a hard book cover panel making process.

FIG. 9 provides a flow chart that illustrates one embodiment of the steps that may be used to produce hard book cover panels and spines using the apparatus described herein. Individual steps may be optional and the order of each step may be altered. Steps also may be repeated or omitted, and additional steps, which are not illustrated, also may be employed.

Having thus described several aspects of at least one embodiment of this invention, it is to be appreciated that various alterations, modifications, and improvements will occur readily to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An apparatus for making book cover panels, the apparatus comprising:

a transport mechanism constructed and arranged to feed a sheet of rigid book cover stock material to a cutting machine;

a vertical cutter constructed and arranged to produce a vertical cut of the sheet of rigid book cover stock material; and a horizontal cutter constructed and arranged to produce a horizontal cut of the sheet of rigid book cover stock material without rotating the material after making a vertical cut, wherein properly dimensioned book cover panels are provided from the sheet of rigid book cover stock material;

wherein the horizontal cutter comprises a blade and an anvil, the anvil having a flat surface, the blade configured to compress against the flat surface of the anvil, the horizontal cutter being constructed and arranged to produce a horizontal crush cut of the sheet of rigid book cover stock material; and wherein the horizontal cutter includes a first toggle linkage rotatable about a first pivot point, a second toggle linkage rotatable about a second pivot point, and an actuator coupled to the first toggle linkage and the second toggle linkage, the actuator being configured to rotate the first toggle linkage about the first pivot point and further configured to rotate the second toggle linkage about the second pivot point, the first toggle linkage including a first pair of link arms coupled at one end to the first pivot point and at the other end to the blade of the horizontal cutter, and further including a second pair of link arms coupled at one end to the first pivot point and at the other end to the anvil, the second toggle linkage including a third pair of link arms coupled at one end to the second pivot point and at the other end to the blade of the horizontal cutter, and further including a fourth pair of link arms coupled at one end to the second pivot point and at the other end to the anvil, such that movement of the actuator translates into raising and lowering of the blade with respect to the anvil via the first toggle linkage and the second toggle linkage.

2. The apparatus of claim 1, wherein the transport mechanism comprises a first set of twin stabilizing rollers constructed and arranged to feed the sheet of rigid book cover stock material.

3. The apparatus of claim 1, wherein the transport mechanism comprises a first set of twin stabilizing rollers constructed and arranged to feed the sheet of rigid book cover stock material and a second set of twin stabilizing rollers constructed and arranged to feed the sheet of rigid book cover stock material.

4. The apparatus of claim 3 wherein the vertical cutter is positioned between the first set of twin stabilizing rollers and the second set of twin stabilizing rollers.

5. The apparatus of claim 1 wherein the vertical cutter comprises a top circular rotating blade and a bottom circular rotating blade constructed and arranged to produce a vertical cut of the sheet of rigid book cover stock material by a cutting and crushing action on the sheet of rigid book cover stock material.

6. The apparatus of claim 5, wherein the sheet of rigid book cover stock material has a thickness, and wherein the top and bottom blades are in the same plane and an edge of the top blade and an edge of the bottom circular blade are separated by a distance that is less than the thickness of the sheet of rigid book cover stock material and greater than 0.003 inches.

7. The apparatus of claim 5, wherein the top and bottom circular blades rotate in opposite directions.

8. The apparatus of claim 5, comprising a second vertical cutter, the second vertical cutter comprising a second top circular rotating blade and a second bottom circular rotating blade constructed and arranged to produce a vertical cut of the sheet of rigid book cover stock material by a cutting and crushing action on the sheet of rigid book cover stock material.

9. The apparatus of claim 1, wherein the vertical cutter is coupled to an adjustable yoke for adjusting a horizontal position of the vertical cut.

10. The apparatus of claim 1, wherein the horizontal cutter constructed and arranged to produce a horizontal cut of the sheet of rigid book cover stock material perpendicular to a cutting axis of the vertical cutter.

11. The apparatus of claim 1 comprising a conveyor belt constructed and arranged to remove cut waste material from a book cover panel.

12. The apparatus of claim 11 comprising a second conveyor belt, wherein the two conveyor belts are parallel and include a space there between, the space narrower than the minimum height of the book cover panel being produced.

13. The apparatus of claim 1 further comprising a controller for directing a horizontal and vertical cutting distance for each sheet of rigid book cover stock material from book cover dimensions.

14. The apparatus of claim 1 comprising a rotating arm including a gripping device for transferring a single sheet of stock material from a feed tray to a guide path.

15. The apparatus of claim 14 wherein the gripping device is in communication with the controller and the gripping device comprises one or more vacuum cups.

16. The apparatus of claim 1, wherein the actuator includes a pneumatic actuator.

17. The apparatus of claim 1, further comprising a piston operatively coupled to the actuator and further operatively coupled to the first toggle linkage.

18. The apparatus of claim 17, wherein the actuator is configured to extend the piston outwardly from the actuator, thereby causing a lowering of the blade with respect to the anvil.

19. The apparatus of claim 17, wherein the actuator is configured to withdraw the piston inwardly toward the actuator, thereby causing a raising of the blade with respect to the anvil.

* * * * *